US011280059B2

(12) United States Patent
Mori et al.

(10) Patent No.: US 11,280,059 B2
(45) Date of Patent: Mar. 22, 2022

(54) HYDRAULIC DRIVE SYSTEM FOR CONSTRUCTION MACHINE

(71) Applicant: Hitachi Construction Machinery Tierra Co., Ltd., Koka (JP)

(72) Inventors: Kazushige Mori, Moriyama (JP); Hajime Yoshida, Omihachiman (JP); Yoshifumi Takebayashi, Koka (JP); Natsuki Nakamura, Koka (JP); Daisuke Oka, Yasu (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 869 days.

(21) Appl. No.: 16/082,447

(22) PCT Filed: Mar. 24, 2017

(86) PCT No.: PCT/JP2017/012162
§ 371 (c)(1),
(2) Date: Sep. 5, 2018

(87) PCT Pub. No.: WO2018/173289
PCT Pub. Date: Sep. 27, 2018

(65) Prior Publication Data

US 2020/0340206 A1 Oct. 29, 2020

(51) Int. Cl.
*E02F 9/22* (2006.01)
*E02F 3/84* (2006.01)

(52) U.S. Cl.
CPC ..... *E02F 3/844* (2013.01); *E02F 9/2203* (2013.01); *E02F 9/2267* (2013.01); *E02F 9/2221* (2013.01)

(58) Field of Classification Search
CPC .. E02F 3/844; E02F 9/2203; F15B 2211/3127
See application file for complete search history.

(56) References Cited

U.S. PATENT DOCUMENTS 3,472,127 A * 10/1969 Scheidt ..... E02F 9/2203 91/437
8,474,254 B2 * 7/2013 Hughes, IV ..... E02F 3/844 60/445

(Continued)

FOREIGN PATENT DOCUMENTS

JP 2002-88796 A 3/2002
JP 2009-155893 A 7/2009
JP 2009155893 A * 7/2009

OTHER PUBLICATIONS

International Preliminary Report on Patentability (PCT/IB/338 & PCT/IB/373) issued in PCT Application No. PCT/JP2017/012162 dated Oct. 3, 2019, including English translation of document C2 (Japanese-language Written Opinion (PCT/ISA/237) previously filed on Sep. 5, 2018) (five (5) pages).

(Continued)

*Primary Examiner* — Thomas E Lazo
(74) *Attorney, Agent, or Firm* — Crowell & Moring LLP

(57) ABSTRACT

A hydraulic drive system for a hydraulic excavator that enables leveling work and a jack-up operation by a blade in a float state, that can prevent a body from falling even when an operator has falsely operated the hydraulic excavator during the jack-up operation by the blade, and that yet can perform favorable leveling work with the blade turned into the float state is provided. A float switch 37, a float valve 38, and a controller 34 are provided, the float valve 38 is changed over to a float position VI upon operating the float switch 37 when the blade is not in a jack-up state, the float valve 38 is changed over from the float position VI to a normal position V when the float valve 38 is in a state of being at the float position VI and an operation lever device 22 has been operated, and the float valve 38 is kept at the normal position V when the float valve 38 is at the normal (Continued)

position V and the float switch 37 has been operated in the jack-up state.

4 Claims, 8 Drawing Sheets

(56) References Cited

U.S. PATENT DOCUMENTS

| | | | | |
|---|---|---|---|---|
| 9,348,327 | B2 * | 5/2016 | Mizuochi | G05B 13/048 |
| 10,995,473 | B2 * | 5/2021 | Takebayashi | E02F 3/844 |
| 2021/0332560 | A1 * | 10/2021 | Takebayashi | E02F 3/964 |

OTHER PUBLICATIONS

International Search Report (PCT/ISA/210) issued in PCT Application No. PCT/JP2017/012162 dated May 30, 2017 (two pages).
Japanese-language Written Opinion (PCT/ISA/237) issued in PCT Application No. PCT/JP2017/012162 dated May 30, 2017 (three pages).
English Translation of document C1 (International Search Report (PCT/ISA/210) issued in PCT Application No. PCT/JP2017/012162 previously filed on Sep. 5, 2018) (one (1) page).

* cited by examiner

HYDRAULIC DRIVE SYSTEM FOR CONSTRUCTION MACHINE

TECHNICAL FIELD

The present invention relates to a hydraulic drive system for a hydraulic excavator, and particularly relates to a hydraulic drive system for a hydraulic excavator that has a blade attached to a front portion of a lower travel structure and that enables leveling work and a jack-up operation by the blade in a float state.

BACKGROUND ART

As a hydraulic drive system for a hydraulic excavator that enables leveling work and a jack-up operation by a blade in a float state, there is known one illustrated in FIG. 5 of Patent Document 1 as a conventional technique of the invention of Patent Document 1. In this conventional technique illustrated in FIG. 5, positions of a blade directional control valve include a float position in which a blade is set into a float state as well as a neutral position in which the blade is stopped, a changeover position in which the blade is driven in a lowering direction, and a changeover position in which the blade is driven in a lifting direction, and the blade directional control valve is configured such that a rod-side hydraulic chamber and a bottom-side hydraulic chamber of a blade cylinder are communicated with a tank when a blade operation lever device is operated to change over the directional control valve to the float position. With this configuration, changeover of the directional control valve to the float position turns the blade into a float state in which the blade is unfixed. At this time, the blade falls by a dead weight thereof to come in contact with the ground. When the hydraulic excavator is moved forward or backward in this state, the blade, which is in the float state, can follow up an undulating shape of the ground even if the ground has undulations; thus, it is possible to perform leveling work with the blade always in contact with the ground.

Furthermore, Patent Document 1 proposes, in FIG. 1, a configuration such that a changeover position (float position) in which a feeding/discharging hydraulic line leading to the bottom-side hydraulic chamber of the blade cylinder is shut off while a feeding/discharging hydraulic line leading to the rod-side hydraulic chamber is communicated with the tank is added as an alternative to the float position of the directional control valve in the conventional technique illustrated in FIG. 5. Moreover, Patent Document 1 proposes, in FIG. 4, that equivalent operations to those in the configuration of FIG. 1 are obtained by providing a selector valve (float valve) in the feeding/discharging hydraulic line in communication with the rod-side hydraulic chamber of the blade cylinder as an alternative to the configuration of FIG. 1 of adding the changeover position to the positions of the blade directional control valve.

PRIOR ART DOCUMENT

Patent Document

Patent Document 1: JP-2002-088796-A

SUMMARY OF THE INVENTION

Problem to be Solved by the Invention

The blade of the hydraulic excavator is used not only for the leveling work but also for jack-up that is a posture taken in cases of maintenance of a suspension system, washing of crawlers, and the like by operating the blade along with a front work implement.

However, according to the conventional technique illustrated in FIG. 5 of Patent Document 1, when false changeover of the position of the blade directional control valve to the float position is conducted during a jack-up operation, the blade is turned into the float state and a body falls.

According to the conventional technique illustrated in FIG. 1 or 4 of Patent Document 1, when either the directional control valve or the float valve is at the float position, the rod-side hydraulic chamber of the blade cylinder is communicated with the tank and the feeding/discharging hydraulic line is closed without communicating the bottom-side hydraulic chamber with the tank. By doing so, even with operator's false changeover of either the directional control valve or the float valve to the float position during the jack-up operation, the blade does not operate in a lifting direction and falling of the body can be prevented since the feeding/discharging hydraulic line leading to the bottom-side hydraulic chamber of the blade cylinder is closed.

However, according to the conventional technique illustrated in FIG. 1 or 4 of Patent Document 1, when the operator changes over either the directional control valve or the float valve to the float position to turn the blade into the float state, the feeding/discharging hydraulic line leading to the bottom-side hydraulic chamber of the blade cylinder is closed. Owing to this, the blade does not fall by the dead weight or has difficulty in falling, does not follow up undulations of the ground, and is unable to perform favorable leveling work.

An object of the present invention is to provide a hydraulic drive system for a hydraulic excavator that enables leveling work and a jack-up operation by a blade in a float state, that can prevent a body from falling even when an operator has falsely operated the hydraulic excavator during the jack-up operation by the blade, and that yet can perform favorable leveling work with the blade turned into the float state.

Means for Solving the Problem

To attain the object, according to the present invention, there is provided a hydraulic drive system for a hydraulic excavator, including: a machine body that has a lower travel structure and an upper swing structure swingably mounted on the lower travel structure; a front work implement attached to the upper swing structure in such a manner as to be vertically rotatable; and a blade attached to a front portion of the lower travel structure. The hydraulic drive system for the hydraulic excavator includes: a plurality of actuators driven by a hydraulic fluid delivered from at least one hydraulic pump; a plurality of directional control valves that control flows of the hydraulic fluid supplied to the plurality of actuators from the hydraulic pump; and a plurality of operation lever devices that are connected to a pilot hydraulic fluid source and that generate control pilot pressures for operating the plurality of directional control valves with a hydraulic pressure of the pilot hydraulic fluid source assumed as a main pressure wherein the plurality of actuators include a blade cylinder for driving the blade, and the plurality of directional control valves include a blade directional control valve that controls the flow of the hydraulic fluid supplied to the blade cylinder, and the plurality of operation lever devices include a blade operation lever device that generates the control pilot pressures for operating the blade directional control valve, and wherein the hydraulic drive system for the hydraulic excavator includes: a float instruction device; a float valve having a normal position that enables the blade cylinder to be driven, and a float position in which a bottom-side hydraulic chamber and a rod-side hydraulic chamber of the blade cylinder are communicated with a tank and in which the blade is turned into a float state; and a float control device configured to change over the float valve to the float position when the blade is not in a state of jacking up the machine body and the float instruction device has been operated, to change over the float valve from the float position to the normal position when the float valve is in a state of being at the float position and the blade operation lever device has been operated, and to keep the float valve at the normal position irrespectively of an instruction by the float instruction device when the float valve is at the normal position, the blade is in the state of jacking up the machine body, and the float instruction device has been operated.

In this way, the float instruction device, the float valve, and the float control device are provided, and the float valve is changed over to the float position when the blade is not in a state of jacking up the machine body and the float instruction device has been operated, thereby communicating a bottom-side hydraulic chamber and a rod-side hydraulic chamber of the blade cylinder with a tank with the float valve at the float position; thus, it is possible to perform favorable leveling work with the blade turned into a float state.

Furthermore, the float instruction device, the float valve, and the float control device are provided, and the float valve is kept at the normal position irrespectively of an instruction by the float instruction device when the float valve is at the normal position, the blade is in a state of jacking up the machine body, and the float instruction device has been operated. As a result, the bottom-side hydraulic chamber and the rod-side hydraulic chamber of the blade cylinder are not communicated with the tank even when the float instruction device has been operated; thus, it is possible to prevent falling of a body even when operator's false operation is made during a jack-up operation by the blade.

Effect of the Invention

According to the present invention, the hydraulic drive system for the hydraulic excavator that enables leveling work and the jack-up operation by the blade in a float state can prevent the body from falling even when an operator has falsely operated the hydraulic excavator during the jack-up operation by the blade, and yet can perform favorable leveling work with the blade turned into the float state.

MODES FOR CARRYING OUT THE INVENTION

Embodiments of the present invention will be described hereinafter with reference to the drawings.

First Embodiment

Configuration

Figure 1:
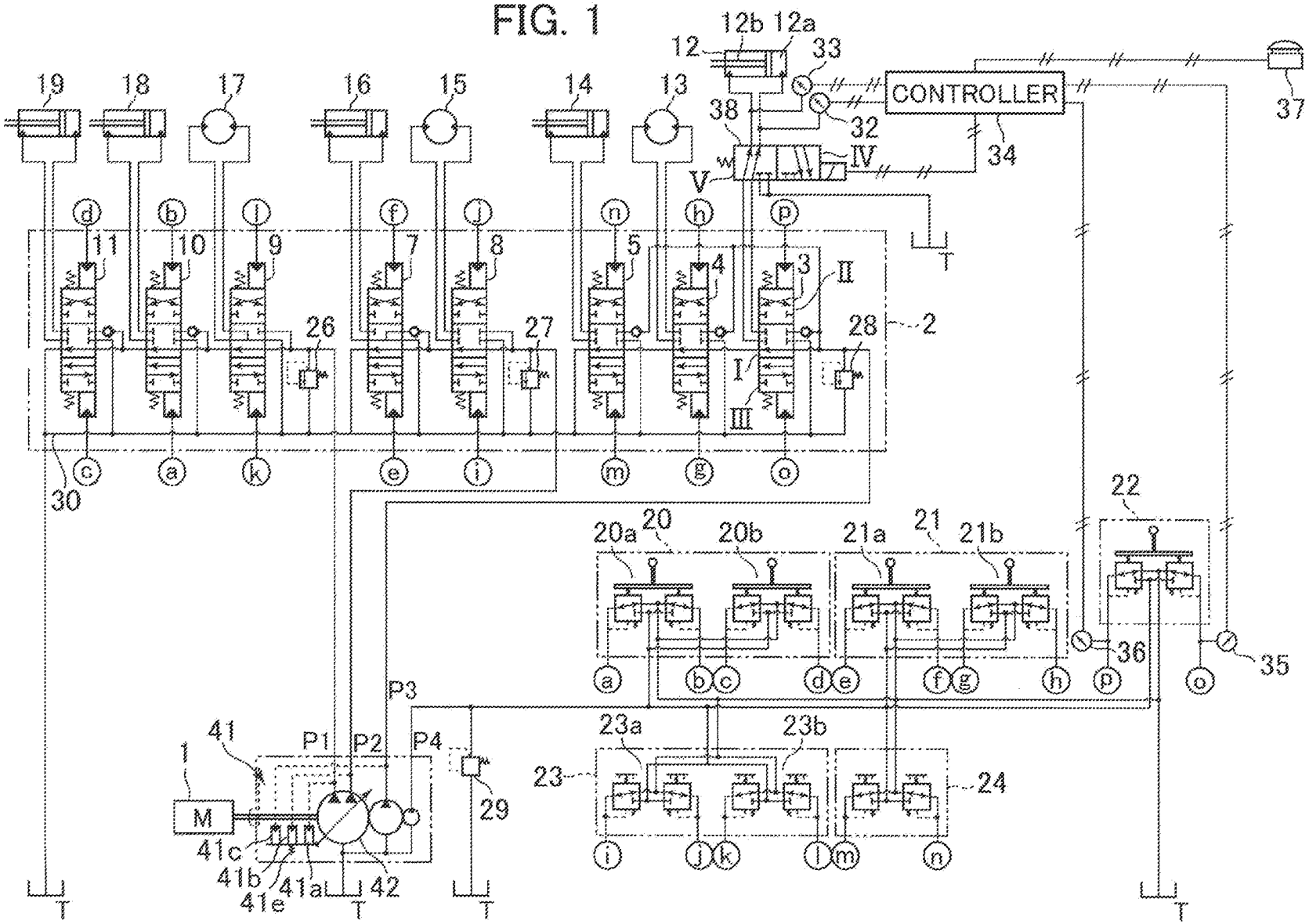
FIG. 1 is a hydraulic circuit diagram illustrating a hydraulic drive system for a construction machine according to a first embodiment of the present invention.

FIG. 1 is a hydraulic circuit diagram illustrating a hydraulic drive system for a construction machine according to a first embodiment of the present invention. In the present embodiment, the construction machine is a small-sized hydraulic excavator.

In FIG. 1, the hydraulic drive system of the present embodiment includes a prime mover (for example, a diesel engine, hereinafter referred to as engine) 1, a first hydraulic pump P1, a second hydraulic pump P2, and a third hydraulic pump P3 that are main pumps driven by the engine 1, a pilot pump P4 that is driven by the engine 1 in such a manner as to be interlocked with the first, second, and third hydraulic pumps P1, P2, and P3, a plurality of actuators 17, 18, and 19 driven by a hydraulic fluid delivered from the first hydraulic pump P1, a plurality of actuators 15 and 16 driven by a hydraulic fluid delivered from the second hydraulic pump P2, a plurality of actuators 12, 13, and 14 driven by a hydraulic fluid delivered from the third hydraulic pump P3, and a control valve 2.

The first and second hydraulic pumps P1 and P2 are variable displacement hydraulic pumps. Furthermore, the first and second hydraulic pumps P1 and P2 are configured by a split-flow hydraulic pump 42 provided with a common regulator 41, and two delivery ports of the split-flow hydraulic pump 42 function as the first and second hydraulic pumps P1 and P2. The third hydraulic pump P3 is a fixed displacement hydraulic pump. The regulator 41 includes torque control (horsepower control) pistons 41*a*, 41*b*, and 41*c* to which delivery pressures of the first, second, and third hydraulic pumps P1, P2, and P3 are introduced, and which reduce tilting (capacities) of the first and second hydraulic pumps P1 and P2 in response to increases of those pressures, and a spring 41*e* that sets a maximum torque which can be used by the first, second, and third hydraulic pumps P1, P2, and P3. It is effective for the small-sized hydraulic excavator to configure the hydraulic drive system by a three-pump system including the split-flow hydraulic pump 42 in the light of constraints on an installation space.

The actuator 12 is a blade cylinder, the actuator 13 is a swing motor, the actuator 14 is a swing cylinder, the actuators 15 and 17 are left and right travel motors, the actuator 16 is an arm cylinder, the actuator 18 is a boom cylinder, and the actuator 19 is a bucket cylinder.

The control valve 2 includes a plurality of open center type directional control valves 9, 10, and 11 that control directions of the hydraulic fluid supplied to the actuators 17, 18, and 19, respectively from the first hydraulic pump P1, a plurality of open center type directional control valves 7 and 8 that control directions of the hydraulic fluid supplied to the actuators 15 and 16, respectively from the second hydraulic pump P2, a plurality of open center type directional control valves 3, 4, and 5 that control directions of the hydraulic fluid supplied to the actuators 12, 13, and 14, respectively from the third hydraulic pump P3, a main relief valve 26 that is provided in a hydraulic fluid supply line for the first hydraulic pump P1 and that limits the delivery pressure of the first hydraulic pump P1, a main relief valve 27 that is provided in a hydraulic fluid supply line for the second hydraulic pump P2 and that limits the delivery pressure of the second hydraulic pump P2, and a main relief valve 28 that is provided in a hydraulic fluid supply line for the third hydraulic pump P3 and that limits the delivery pressure of the third hydraulic pump P3. Output sides of the main relief valves 26, 27, and 28 are connected to a tank hydraulic line 30 within the control valve 2 and connected to a tank T. In this way, the hydraulic drive system of the present embodiment is configured as an open center system provided with the open center directional control valves 3 to 11.

Moreover, the hydraulic drive system of the present embodiment includes a pilot relief valve 29 that is connected to a hydraulic fluid supply line for the pilot pump P4 and that keeps constant a pressure of the pilot pump P4, and operation lever devices 20, 21, and 22 and operation pedal devices 23 and 24 that are connected to the hydraulic fluid supply line for the pilot pump P4 and that include remote control valves for generating control pilot pressures a, b, c, d, e, f, g, h, i, j, k, l, m, n, o, and p for operating the directional control valves 3 to 11 with a hydraulic pressure of the pilot pump P4 assumed as a main pressure. The operation lever device 20 has a boom operation lever device 20*a* and a bucket operation lever device 20*b*, and the operation lever device 21 has an arm operation lever device 21*a* and a swing operation lever device 21*b*. The operation lever device 22 is a blade operation lever device. The operation pedal device 23 has a right travel operation pedal device 23*a* and a left travel operation pedal device 23*b*. The operation pedal device 24 is a swing operation pedal device.

Figure 2:
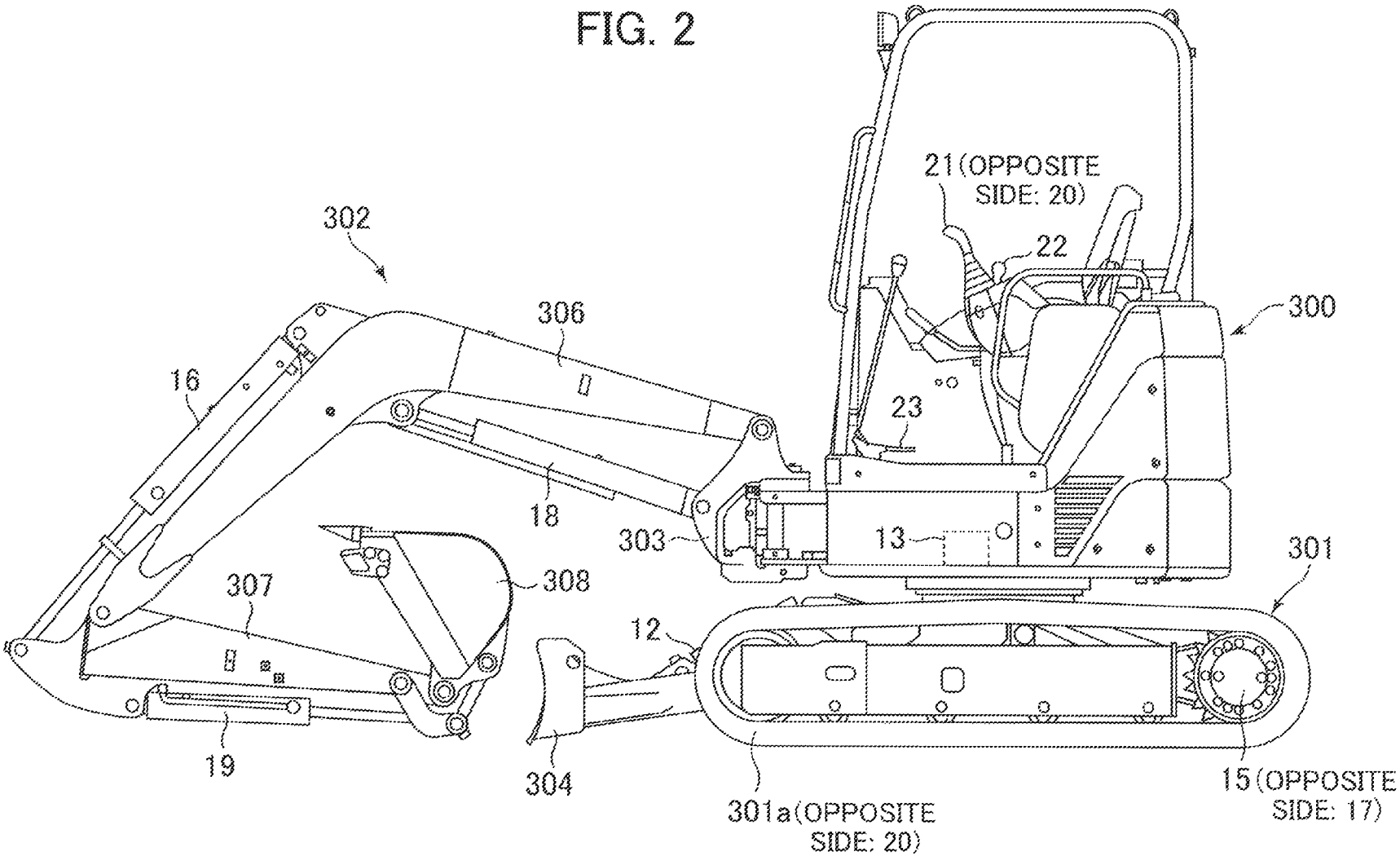
FIG. 2 is diagram illustrating an outward appearance of a hydraulic excavator to which the present invention is applied.

FIG. 2 is a diagram illustrating an outward appearance of the small-sized hydraulic excavator to which the present invention is applied.

In FIG. 2, the hydraulic excavator includes an upper swing structure 300, a lower travel structure 301, and a front work implement 302, and the upper swing structure 300 is swingable with respect to the lower travel structure 301 by rotation of the swing motor 13. The upper swing structure 300 and the lower travel structure 301 configure a machine body.

A swing post 303 is attached to a front portion of the upper swing structure 300, and the front work implement 302 is attached to this swing post 303 in such a manner as to be vertically movable. The front work implement 302 has a boom 306, an arm 307, and a bucket 308 that are of a multijoint structure, and operating operation levers of the operation lever devices 20 and 21 to expand/contract the boom cylinder 18, the arm cylinder 16, and the bucket cylinder 19 causes the boom 306, the arm 307, and the bucket 308 to rotate to change a posture of the front work implement 302.

The lower travel structure 301 includes left and right crawler travel devices 301*a* and 301*b* and travels by causing the travel motors 15 and 17 to drive the travel devices 301*a* and 301*b*. A blade 304 is attached to a central frame between the left and right crawler travel devices 301*a* and 301*b*, and the blade 304 operates vertically by expansion/contraction of the blade cylinder 12 (refer to FIG. 4).

Reference is made back to FIG. 1. The hydraulic drive system of the present embodiment further includes, as a characteristic configuration thereof, a float valve 38 that is a valve device disposed in an actuator hydraulic line between the blade directional control valve 3 and the blade cylinder 12 and having a position changeable over between a normal position V and a float position VI, a first pressure sensor 32 (a jack-up sensor) that detects a pressure of a bottom-side hydraulic chamber 12*a* of the blade cylinder 12, a second pressure sensor 33 (the jack-up sensor) that detects a pressure of a rod-side hydraulic chamber 12*b* of the blade cylinder 12, third and fourth pressure sensors 35 and 36 (a blade operation sensor) that detect control pilot pressures o and p generated by the blade operation lever device 22, a float switch 37 (float instruction device) operated by an operator, and a controller 34 that changes over the float valve 38 to one of the normal position V and the float position VI on the basis of detection signals of the first and second pressure sensors 32 and 33 and the third and fourth pressure sensors 35 and 36 and an instruction signal of the float switch 37.

The float valve 38 is a solenoid selector valve changed over in response to a control signal (electrical signal) from the controller 34. Furthermore, at the normal position V, the float valve 38 connects two actuator ports of the blade directional control valve 3 to the bottom-side hydraulic chamber 12*a* and the rod-side hydraulic chamber 12*b* of the blade cylinder 12, respectively to enable the blade directional control valve 3 to drive the blade cylinder 12. At the float position VI, the float valve 38 connects the bottom-side hydraulic chamber 12*a* and the rod-side hydraulic chamber 12*b* of the blade cylinder 12 to a tank T and the blade 304 is turned into a float state.

Figure 3:
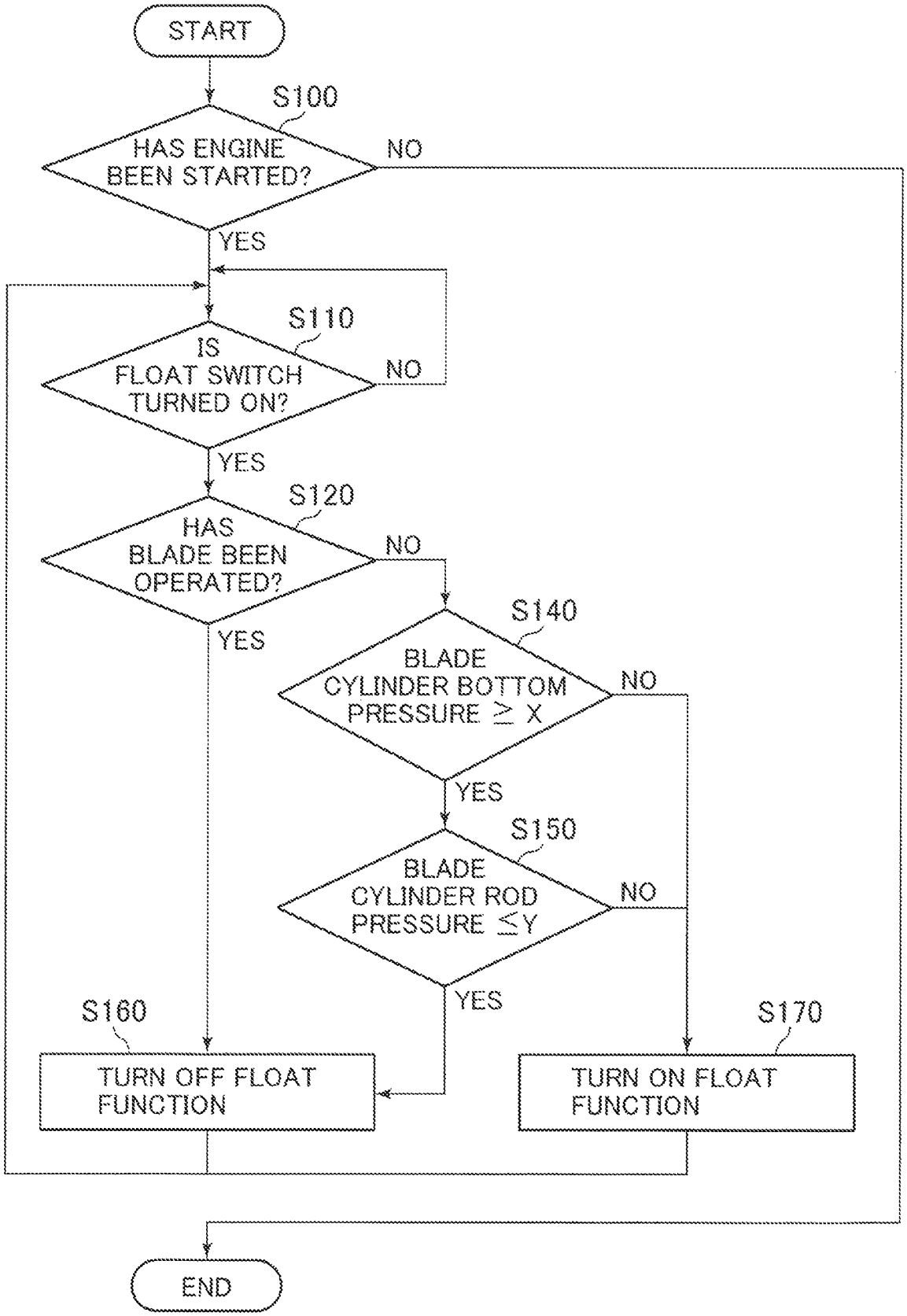
FIG. 3 is a flowchart illustrating a control function of a controller in the first embodiment.

FIG. 3 is a flowchart illustrating a control function of the controller 34.

First, the controller 34 determines whether the engine 1 has been started (Step S100). The controller 34 makes this determination by determining whether a start signal has been input from a starter switch (not depicted) of the engine 1. Upon determining that the engine 1 has not been started, the controller 34 ends a process.

Upon determining that the engine 1 has been started, the controller 34 determines whether the float switch 37 has been operated (is turned on) (Step S110). The controller 34 makes this determination by determining whether an instruction signal has been input from the float switch 37. Upon determining that the float switch 37 has not been operated (is turned off), the controller 34 repeats the process. Furthermore, upon determining that the float switch 37 has been operated (is turned on), the controller 34 then determines whether the blade 304 has been operated (Step S120). The controller 34 makes this determination on the basis of the detection signals from the third and fourth pressure sensors 35 and 36. More specifically, the controller 34 determines whether the control pilot pressures o and p generated by the blade operation lever device 22 are equal to or higher than a minimum effective pressure obtained by adding a dead-band pressure to a tank pressure Pi0. When the control pilot pressures o and p are equal to or higher than the minimum effective pressure, the controller 34 determines that the blade 304 has been operated. When the control pilot pressures o and p are lower than the minimum effective pressure, the controller 34 determines that the blade 304 has not been operated.

Upon determining that the blade 304 has been operated, the controller 34 then performs a process for turning off a float function (Step S160). In this process, when the float switch 37 is turned off and the float valve 38 is at the normal position V, then the controller 34 does not do anything and keeps the float valve 38 at the normal position V. When the float switch 37 is turned on and the float valve 38 has been changed over to the float position VI, the controller 34 turns off the control signal output to the float valve 38 to changes over the float valve to the normal position V.

Upon determining in Step S120 that the blade 304 has not been operated, the controller 34 then determines whether the pressure of the bottom-side hydraulic chamber 12*a* of the blade cylinder 12 is equal to or higher than a first determination pressure X using the detection signal from the first pressure sensor 32 (Step S140), and further determines whether the pressure of the rod-side hydraulic chamber 12*b* of the blade cylinder 12 is equal to or lower than a second determination pressure Y using the detection signal from the second pressure sensor 33 (Step S150).

Figure 8:
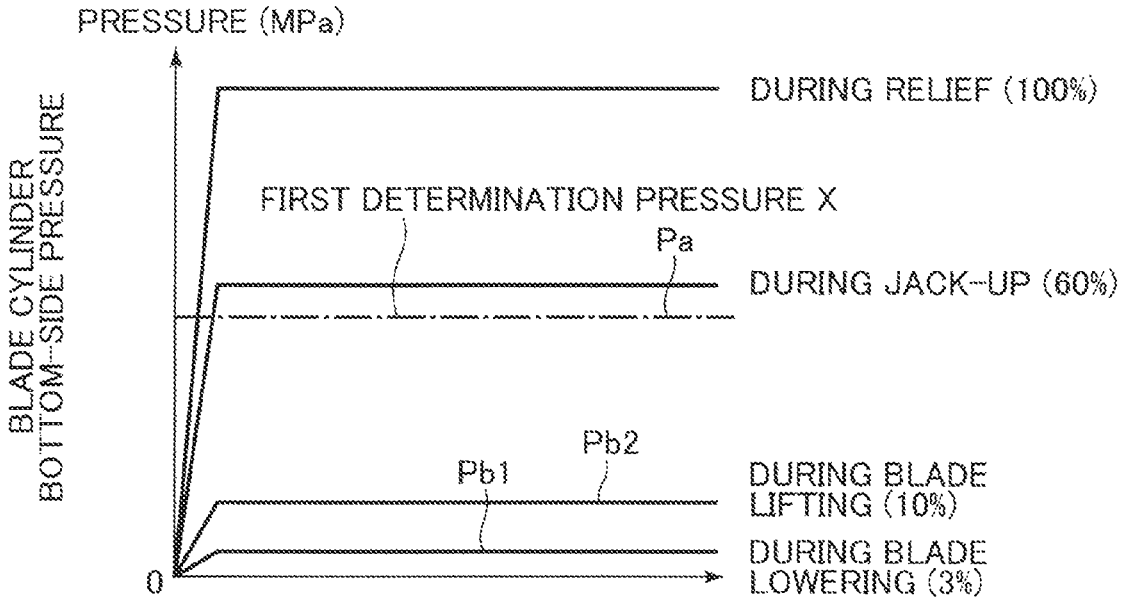
FIG. 8 is a diagram illustrating typical pressures generated in a bottom-side hydraulic chamber and a rod-side hydraulic chamber of a blade cylinder during the jack-up operation of the blade in a hydraulic excavator in a three ton weight class while being compared with a first determination pressure and a second determination pressure.
Figure 8:
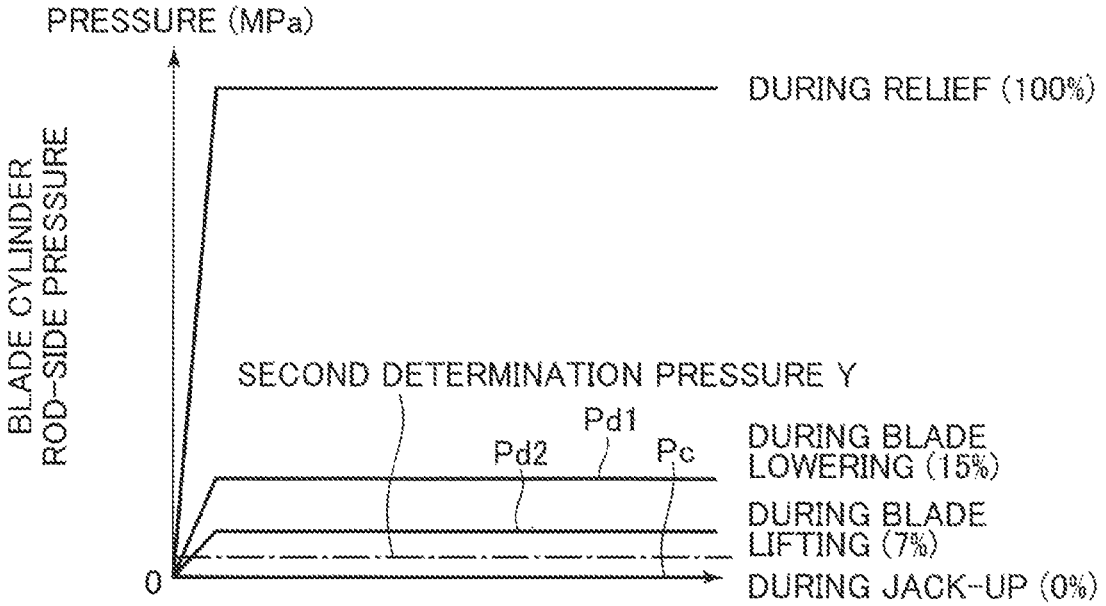

FIG. 8 is a diagram illustrating typical pressures generated in the bottom-side hydraulic chamber 12*a* and the rod-side hydraulic chamber 12*b* of the blade cylinder 12 during a jack-up operation by the blade 304 in the hydraulic excavator in a three ton weight class while being compared with the first determination pressure X and the second determination pressure Y. As illustrated in FIG. 8, the first determination pressure X is set to a value lower than a pressure Pa generated in the bottom-side hydraulic chamber 12*a* of the blade cylinder 12 during the jack-up operation of the blade 304 and higher than pressures Pb1 and Pb2 generated in the bottom-side hydraulic chamber 12*a* of the blade cylinder 12 when operations other than the jack-up by the blade 304 are performed. The second determination pressure Y is set to a value higher than a pressure Pc generated in the rod-side hydraulic chamber 12*b* of the blade cylinder 12 during the jack-up operation and lower than pressures Pd1 and Pd2 generated in the rod-side hydraulic chamber 12*b* of the blade cylinder 12 in the case of performing the operations other than the jack-up by the blade 304.

When it has been determined in Step S140 that the pressure of the bottom-side hydraulic chamber 12*a* of the blade cylinder 12 is equal to or higher than the first determination pressure X and having determined in Step S150 that the pressure of the rod-side hydraulic chamber 12*b* of the blade cylinder 12 is equal to or lower than the second determination pressure Y, the controller 34 determines that the blade 304 is in a state of jacking up the machine body and performs a process for turning off the float function (Step S160). When it has been determined in Step S140 that the pressure of the bottom-side hydraulic chamber 12*a* of the blade cylinder 12 is lower than the first determination pressure X or having determined in Step S150 that the pressure of the rod-side hydraulic chamber 12*b* of the blade cylinder 12 is higher than the second determination pressure Y, the controller 34 determines that the blade 304 is in a state of not jacking up the machine body and performs a process for turning on the float function (Step S170). In this way, the controller 34 can accurately determine whether the blade 304 is in a jack-up state by checking not only whether the pressure of the bottom-side hydraulic chamber 12*a* of the blade cylinder 12 is equal to or higher than the first determination pressure X but also whether the pressure of the rod-side hydraulic chamber 12*b* of the blade cylinder 12 is higher than the second determination pressure Y.

It is noted that the controller 34 may determine whether the blade 304 is in the jack-up state by checking only the pressure of one of the bottom-side hydraulic chamber 12*a* and the rod-side hydraulic chamber 12*b* of the blade cylinder 12, preferably only the pressure of the bottom-side hydraulic chamber 12*a* of the blade cylinder 12.

In the process for turning off the float function in Step S160, the controller 34 does not do anything and keeps the float valve 38 at the normal position V when the float switch 37 is turned off and the float valve 38 is at the normal position V. Further, the controller 34 turns off the control signal output to the float valve 38 and changes over the float valve 38 to the normal position V when the float switch 37 is turned on and the float valve 38 has been changed over to the float position VI.

In the process for turning on the float function in Step S170, the controller 34 outputs the control signal to the float valve 38 to change over the float valve 38 to the float position VI.

In the description given above, the first and second pressure sensors 32 and 33, the third and fourth pressure sensors 35 and 36, and the controller 34 provide a float control device configured to change over the float valve 38 to the float position VI when the blade 304 is not in a state of jacking up the machine body and the float switch 37 (float instruction device) has been operated, to change over the float valve 38 from the float position VI to the normal position V when the float valve 38 is in a state of being at the float position VI and the blade operation lever device 22 has been operated, and to keep the float valve 38 at the normal position V irrespectively of an instruction by the float switch 37 (float instruction device) when the float valve 38 is at the normal position V, the blade 304 is in the state of jacking up the machine body and the float switch 37 (float instruction device) has been operated.

Operations

Operations performed by the hydraulic drive system of the present embodiment will be described.

Basic Operations

When the operation levers of the operation lever devices 20*a* and 20*b* and an operation pedal of the operation pedal device 23*b* are neutral, then the directional control valves 9, 10, and 11 are at neutral positions, and the hydraulic fluid delivered from the first hydraulic pump P1 is returned to the tank T via the directional control valves 9, 10, and 11. When any of the operation levers of the operation lever devices 20*a* and 20*b* and the operation pedal of the operation pedal device 23*b* is operated, then the directional control valves 9, 10, and 11 are changed over, and inflow/discharge directions of the hydraulic fluid to/from the actuators (the travel motor 17, the boom cylinder 18, and the bucket cylinder 19) are controlled to actuate the actuators (the travel motor 17, the boom cylinder 18, and the bucket cylinder 19).

When the operation lever of the operation lever device 21*a* and an operation pedal of the operation pedal device 23*a* are neutral, then the directional control valves 7 and 8 are at neutral positions, and the hydraulic fluid delivered from the second hydraulic pump P2 is returned to the tank T via the directional control valves 7 and 8. When any of the operation lever of the operation lever device 21*a* and the operation pedal of the operation pedal device 23*a* is operated, then the directional control valves 7 and 8 are changed over, and inflow/discharge directions of the hydraulic fluid to/from the actuators (the travel motor 15 and the arm cylinder 16) are controlled to actuate the actuators (the travel motor 15 and the arm cylinder 16).

The same thing is true for the third hydraulic pump P3. When the operation levers of the operation lever devices 21*b* and 22 and an operation pedal of the operation pedal device 24 are neutral, then the directional control valves 3, 4, and 5 are at neutral positions, and the hydraulic fluid delivered from the third hydraulic pump P3 is returned to the tank T via the directional control valves 3, 4, and 5. When any of the operation levers of the operation lever devices 21*b* and 22 and the operation pedal of the operation pedal device 24 is operated, then the directional control valves 3, 4, and 5 are changed over, and inflow/discharge directions of the hydraulic fluid to/from the actuators (the blade cylinder 12, the swing motor 13, and the swing cylinder 14) are controlled to actuate the actuators (the blade cylinder 12, the swing motor 13, and the swing cylinder 14).

Float Operation

A float operation is an operation for enabling the blade 304 to perform leveling work with the blade 304 always in contact with the ground even if the ground has undulations. When this float operation is performed, the operator turns on the float switch 37 to change over the float valve 38 from the normal position V to the float position VI (Step S100→Step S110→Step S120→Step S140→Step S170 of FIG. 3). At this changeover position, the bottom-side hydraulic chamber 12*a* and the rod-side hydraulic chamber 12*b* of the blade cylinder 12 are communicated with the tank T and the blade 304 is in a float state in which the blade 304 is unfixed. At this time, the blade 304 falls by a dead weight thereof to come in contact with the ground. When the hydraulic excavator is moved forward or backward in this state, the blade 304, which is in the float state, can follow up an undulating shape of the ground even if the ground has the undulations. It is, therefore, possible to perform the leveling work with the blade 304 always in contact with the ground.

Jack-Up Operation

The blade 304 is used not only for the leveling work but also for jack-up that is a posture taken in cases of maintenance of a suspension system, washing of crawlers of the travel devices 301*a* and 301*b*, and the like by operating the blade 304 along with the front work implement 302.

Figure 4:
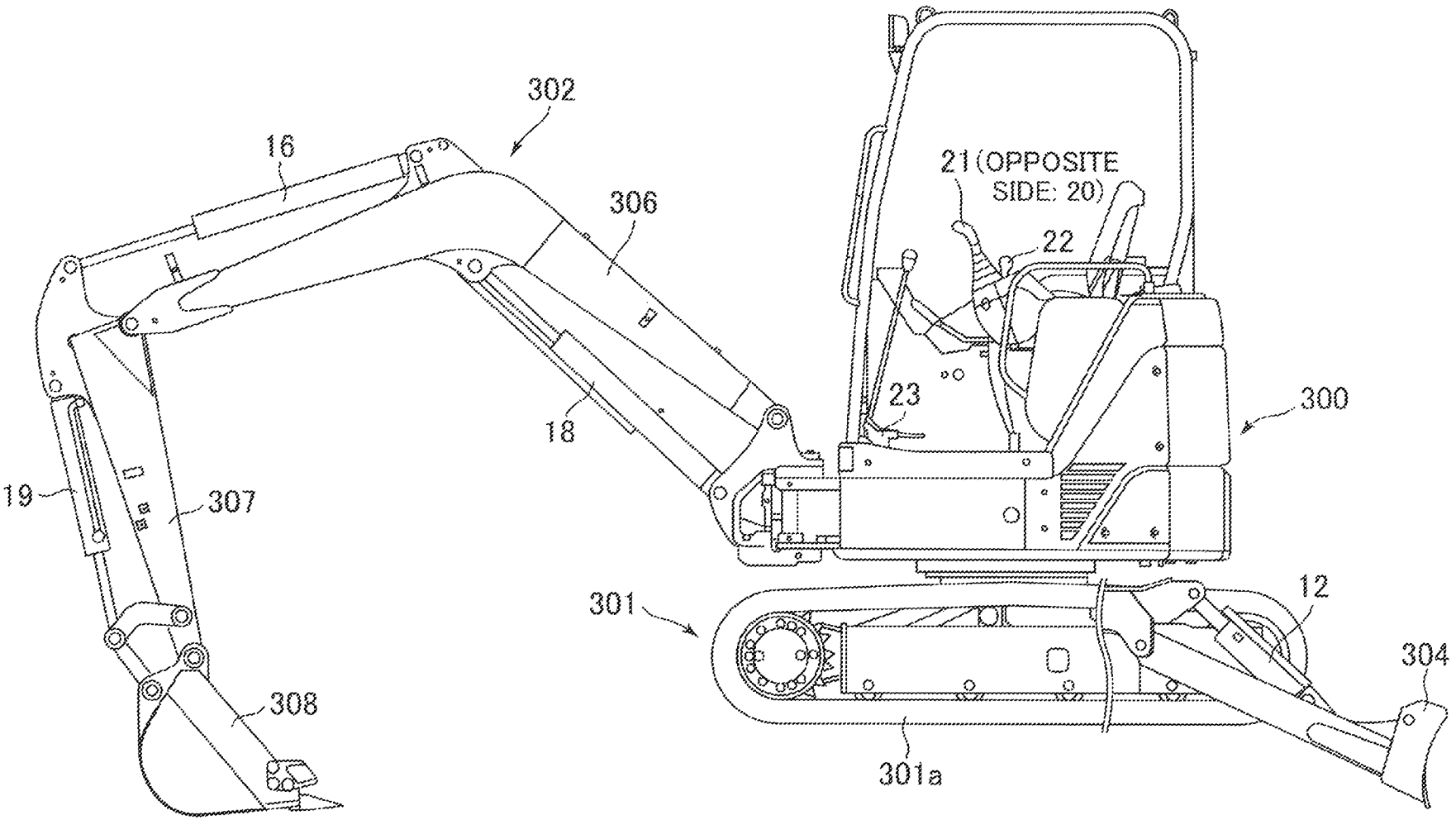
FIG. 4 is a diagram illustrating a state in which a machine body of the hydraulic excavator is jacked up by a front work implement and a jack-up operation of the blade.

FIG. 4 is a diagram illustrating a state in which the machine body of the hydraulic excavator is being jacked up by the jack-up operation of the front work implement 302 and the blade 304. In FIG. 4, as indicated by double wavy lines, the lower travel structure 301 is illustrated in such a manner that the travel device 301*a* is partially cut to make visible an attachment state of the blade cylinder 12. The blade cylinder 12 is link-coupled to a main body portion of the lower travel structure 301 and the blade 304 in such a manner as to drive the blade 304 in the lowering direction by driving the blade cylinder 12 in an extension direction.

The jack-up operation of this blade 304 is performed by turning off the float switch 37 in a state in which the float valve 38 is at the normal position V illustrated in FIG. 2. For example, after operating the swing operation lever device 21*b* to invert the upper swing structure 300 by 180 degrees, the operator causes the front work implement 302 to take a posture such that the bucket 308 contacts the ground as illustrated in FIG. 4. In this state, the operator operates the boom operation lever device 20*a* in a boom lowering direction to drive the boom cylinder 18 in a contraction direction, thereby driving the boom 306 in the lowering direction and floating a rear portion of the lower travel structure 301 from the ground. Next, the operator operates the blade operation lever device 22 in the blade lowering direction to change over the directional control valve 3 from the neutral position I of FIG. 1 to a lower position III thereof, the hydraulic fluid delivered from the third hydraulic pump P3 is supplied to the bottom-side hydraulic chamber 12*a* of the blade cylinder 12 to drive the blade cylinder 12 in an extension direction, thereby driving the blade 304 in the lowering direction and floating a front portion of the lower travel structure 301 from the ground to cause the machine body to take a posture as illustrated in FIG. 4.

In such a jack-up operation, the hydraulic fluid delivered from the third hydraulic pump P3 is supplied to the bottom-side hydraulic chamber 12*a* of the blade cylinder 12 to drive the blade cylinder 12 in the extension direction as described above. At this time, the blade 304 is pressed against the ground to float the machine body. Owing to this, as illustrated in FIG. 8, the pressure of the bottom-side hydraulic chamber 12*a* of the blade cylinder 12 is quite high while the pressure of the rod-side hydraulic chamber 12*b* of the blade cylinder 12 is a low pressure close to the tank pressure because of a small discharge amount of the hydraulic fluid.

The first determination pressure X and the second determination pressure Y used in determination of the jack-up operation in Steps S140 and S150 of the flowchart illustrated in FIG. 3 are set in the light of pressure changes during such a jack-up operation.

Case of Operating Blade Operation Lever Device 22 in Blade Lowering Direction with Intention of Performing Blade Lowering Operation 1. Case in which Jack-Up is not being Performed When the blade 304 is not performing the jack-up operation, the pressure of the bottom-side hydraulic chamber 12*a* of the blade cylinder 12 is lower than the first determination pressure X. Owing to this, the controller 34 determines that the blade 304 is in the state of not jacking up the machine body (body), and performs the process for turning on the float function even when the float switch 37 has been operated and the blade operation lever device 22 has been operated (Step S100→S110→S120→S140→S170). At this time, the float valve 38 is at the normal position V illustrated in FIG. 1.

In this state, when the operator has operated the blade operation lever device 22 in the blade lowering direction for performing an ordinary blade lowering operation without performing the float operation, then the directional control valve 3 strokes out from the neutral position I of FIG. 3 to the lower position III thereof, the hydraulic fluid delivered from the third hydraulic pump P3 flows into the bottom-side hydraulic chamber 12*a* of the blade cylinder 12, and the blade cylinder 12 is driven in the extension direction to drive the blade 304 in the lowering direction.

Furthermore, when the operator has operated the float switch 37 with an intention to perform the float operation, then the float valve 38 is changed over from the normal position V of FIG. 1 to the right float position VI thereof (Step S100→Step S110→Step S120→Step S140→Step S170 of FIG. 3), the bottom-side hydraulic chamber 12*a* and the rod-side hydraulic chamber 12*b* of the blade cylinder 12 are communicated with the tank T, and the blade 304 is turned into the float state.

When the operator has operated the blade operation lever device 22 in the blade lowering direction while the blade 304 is in the float state, then either the control pilot pressure o or the control pilot pressure p is detected by the pressure sensor 35 or 36, the float valve 38 is changed over from the float position VI of FIG. 1 to the right normal position thereof (Step S100→Step S110→Step S120→Step S160 of FIG. 3) even when the float switch 37 is turned on, and the blade 304 gets out of the float state. Furthermore, the directional control valve 3 strokes out from the neutral position I of FIG. 1 to the lower position III thereof, and the hydraulic fluid delivered from the third hydraulic pump P3 flows into the bottom-side hydraulic chamber 12*a* of the blade cylinder 12 to drive the blade 304 in the lowering direction. In this way, even with the blade 304 in the float state, the float state is cancelled immediately by operator's operating the blade operation lever device 22, and the operation lever device 22 can drive the blade 304 in an ordinary way.

2. Case in which Jack-Up is being Performed

When the blade 304 is performing the jack-up operation, the pressure of the bottom-side hydraulic chamber 12*a* of the blade cylinder 12 is equal to or higher than the first determination pressure X and the pressure of the rod-side hydraulic chamber 12*b* of the blade cylinder 12 is equal to or lower than the second determination pressure Y. Owing to this, the controller 34 determines that the blade 304 is jacking up the machine body (body), and performs the process for turning off the float function even when the float switch 37 has been operated and the blade operation lever device 22 has been operated (Step S100→Step S110→Step S120→Step S160).

In this state, when the operator has operated the blade operation lever device 22 in the blade lowering direction for performing the ordinary blade lowering operation without performing the float operation, then the directional control valve 3 strokes out from the neutral position I of FIG. 1 to the lower position III thereof, the hydraulic fluid delivered from the third hydraulic pump P3 flows into the bottom-side hydraulic chamber 12*a* of the blade cylinder 12, and the blade cylinder 12 is driven in the extension direction to drive the blade 304 in the lowering direction.

Furthermore, when the operator has falsely operated the float switch 37 with the machine body taking a jack-up posture, the controller 34 determines that the blade 304 is jacking up the machine body (body) from the detection signals of the pressure sensors 32 and 33. Owing to this, the float valve 38 is not changed over to the float position VI (Step S100→Step S110→Step S120→Step S140→Step S150→Step S160 of FIG. 3), the bottom-side hydraulic chamber 12*a* and the rod-side hydraulic chamber 12*b* of the blade cylinder 12 are not communicated with the tank T, and the blade 304 is not turned into the float state. It is thereby possible to prevent the blade 304 from being turned into the float state and prevent falling of the body even when the operator has falsely operated the float switch 37 during the jack-up.

Effects

As described so far, according to the present embodiment, when the blade 304 is not in the state of jacking up the machine body, the float switch 37 (float instruction device) is operated to change over the float valve 38 to the float position VI, thereby communicating the bottom-side hydraulic chamber 12*a* and the rod-side hydraulic chamber 12*b* of the blade cylinder 12 with the tank T with the float valve 38 at the float position VI; thus, it is possible to perform favorable leveling work with the blade 304 turned into the float state.

Furthermore, when the float valve 38 is at the normal position V, the blade 304 is in the state of jacking up the machine body, and the float switch 37 (float instruction device) has been operated, the float valve 38 is kept at the normal position V irrespectively of an instruction by the float switch 37. As a result, the bottom-side hydraulic chamber 12*a* and the rod-side hydraulic chamber 12*b* of the blade cylinder 12 are not communicated with the tank T even when the float switch 37 has been operated; thus, it is possible to prevent the falling of the body even when operator's false operation occurs during the jack-up operation by the blade 304.

Moreover, according to the present embodiment, an ordinary directional control valve can be used as the blade directional control valve 3; thus, the hydraulic drive system that can attain the above effects can be configured without changing the control valve 2. Furthermore, only the float control device (first and second pressure sensors 32 and 33, the third and fourth pressure sensors 35 and 36, and the controller 34) may be added to the hydraulic drive system; thus, the hydraulic drive system that can attain the above effects can be easily configured by modification of an existing hydraulic drive system.

Second Embodiment

Configuration

Figure 5:
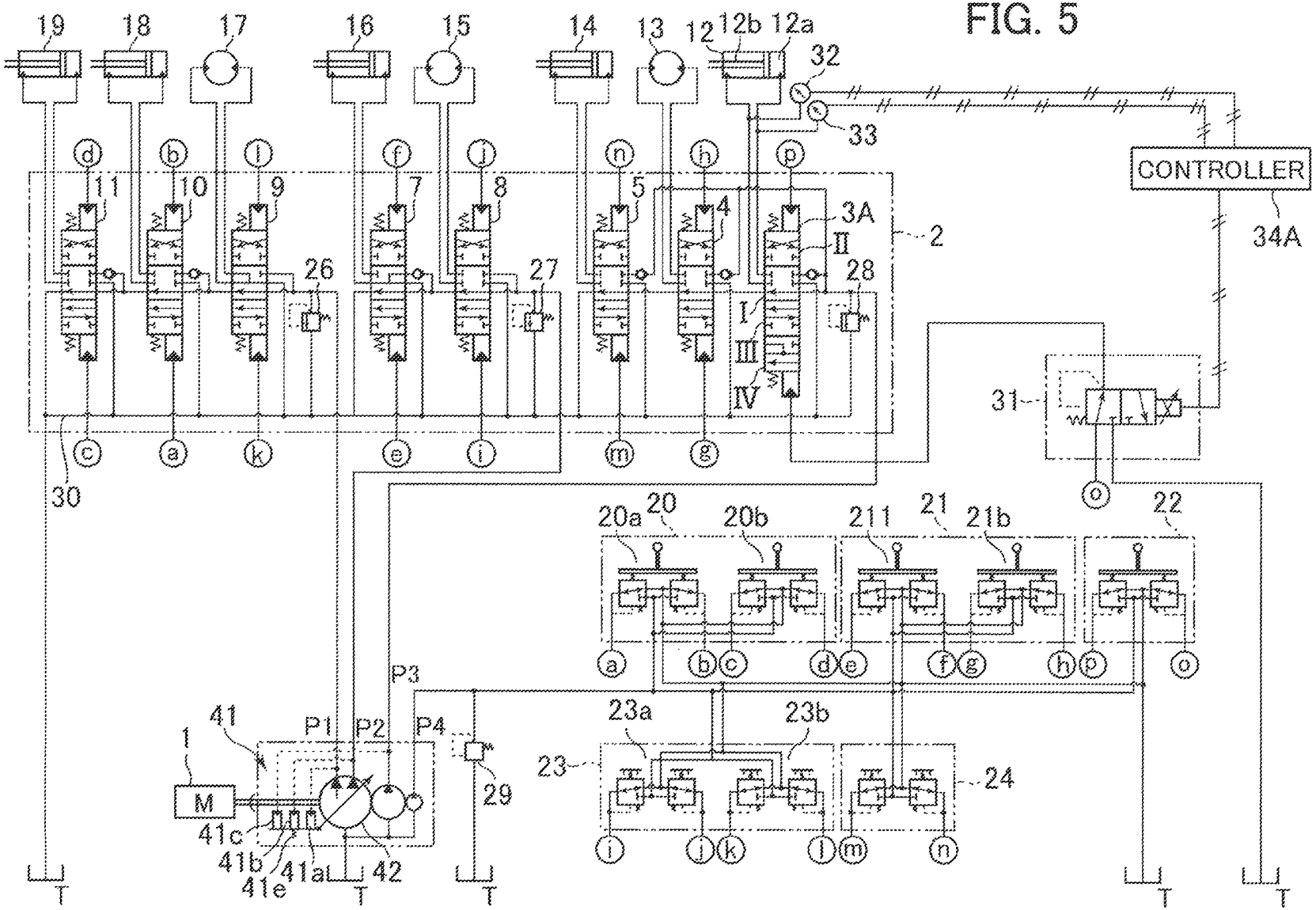
FIG. 5 is a hydraulic circuit diagram illustrating a hydraulic drive system for a construction machine according to a second embodiment of the present invention.

FIG. 5 is a hydraulic circuit diagram illustrating a hydraulic drive system for a construction machine according to a second embodiment of the present invention. In the present embodiment, the blade operation lever device 22 also functions as a float instruction device and that the float valve is integrally incorporated into the blade directional control valve 3.

In other words, in FIG. 5, a blade directional control valve 3A has changeover positions including a neutral position I, a blade lifting position II, a blade lowering position III (normal position), and a float position IV in which the blade 304 is turned into the float state.

Figure 6:
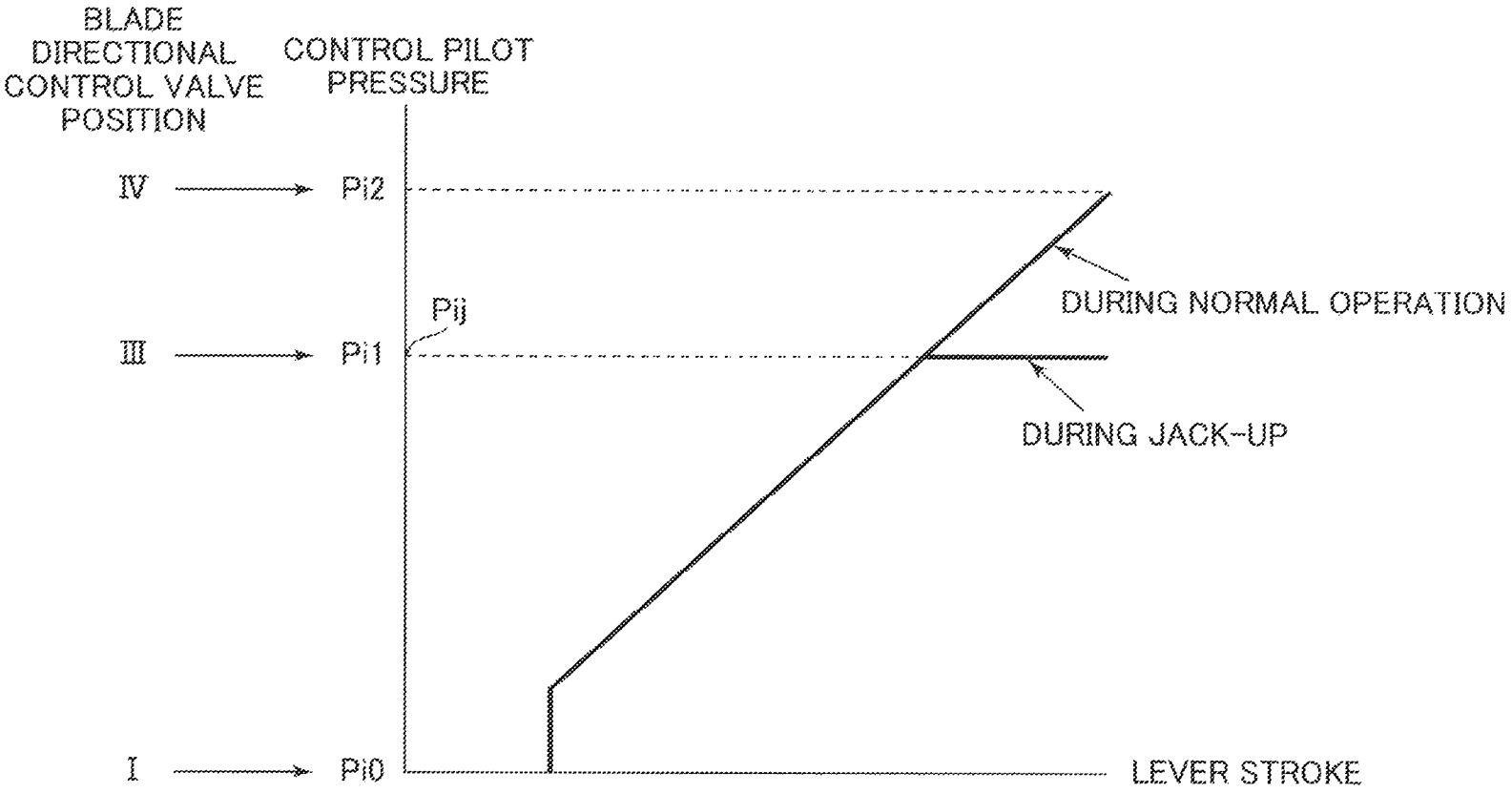
FIG. 6 is a diagram illustrating a relationship among a lever stroke, a control pilot pressure, and changeover positions of a blade directional control valve when a blade operation lever device has been operated in a boom lowering direction.

FIG. 6 is a diagram illustrating a relationship among a lever stroke, the control pilot pressure o, and the changeover positions of the blade directional control valve 3A when the blade operation lever device 22 is operated in a boom lowering direction.

When the blade operation lever device 22 is operated in the boom lowering direction and the lever stroke exceeds a deadband, the control pilot pressure o rises as the lever stroke is greater. When the control pilot pressure o rises and becomes equal to a first set pressure Pi1, the directional control valve 3A strokes out from the neutral position I of FIG. 5 to the normal position III. At this time, the hydraulic fluid delivered from the third hydraulic pump P3 flows into the bottom-side hydraulic chamber 12*a* of the blade cylinder 12 to drive the blade cylinder 12 in the extension direction (blade lowering direction).

When the blade operation lever device 22 is further operated up to a detent position (maximum stroke position), the control pilot pressure o rises up to a second set pressure Pi2 of FIG. 6. At this time, the directional control valve 3A makes a full stroke to be located at the float position IV of FIG. 5. At this float position IV, the bottom-side hydraulic chamber 12*a* and the rod-side hydraulic chamber 12*b* of the blade cylinder 12 are communicated with the tank T and the blade 304 is turned into the float state.

In this way, the blade directional control valve 3A is changed over to the blade lowering position III (normal position) when the blade operation lever device 22 has been operated in the blade lowering direction and the control pilot pressure o rises up to the first predetermined pressure Pi1, and the blade directional control valve 3A is changed over to the float position IV when the blade operation lever device 22 has been operated in the blade lowering direction and the control pilot pressure o rises up to the second set pressure Pi2 higher than the first predetermined pressure Pi1.

In FIG. 5, the hydraulic drive system of the present embodiment includes, as a characteristic configuration thereof, the first and second pressure sensors 32 and 33 that detect the pressures of the bottom-side hydraulic chamber 12*a* and the rod-side hydraulic chamber 12*b* of the blade cylinder 12, similarly to the first embodiment. Furthermore, the hydraulic drive system of the present embodiment does not include the float valve 38 and the third and fourth pressure sensors 35 and 36 that detect the control pilot pressures o and p generated by the blade operation lever device 22, but includes, as an alternative to the float valve 38 and the third and fourth pressure sensors 35 and 36, a solenoid pressure reducing valve 31 that is disposed between a boom-lowering-side output port of the blade operation lever device 22 and a boom-lowering-side pressure receiving section of the blade directional control valve 3A, and a controller 34A that outputs a control signal to the solenoid pressure reducing valve 31 on the basis of the detection signals of the first and second pressure sensors 32 and 33.

The solenoid pressure reducing valve 31 outputs the control pilot pressure o generated by the blade operation lever device 22 as it is when the control signal is not output from the controller 34A. Furthermore, when the control signal is output from the controller 34A, the solenoid pressure reducing valve 31 outputs the control pilot pressure o generated by the blade operation lever device 22 as it is when the control pilot pressure o is equal to or lower than a preset limit pressure Pij, and reduces the control pilot pressure o to the limit pressure Pij and outputs the limit pressure Pij when the control pilot pressure o is higher than the limit pressure Pij. The limit pressure Pij is set to, for example, a value equal to the first set pressure Pi1 of FIG. 6. The limit pressure Pij may be set to an arbitrary value higher than the first set pressure Pi1 and lower than the second set pressure Pi2.

Figure 7:
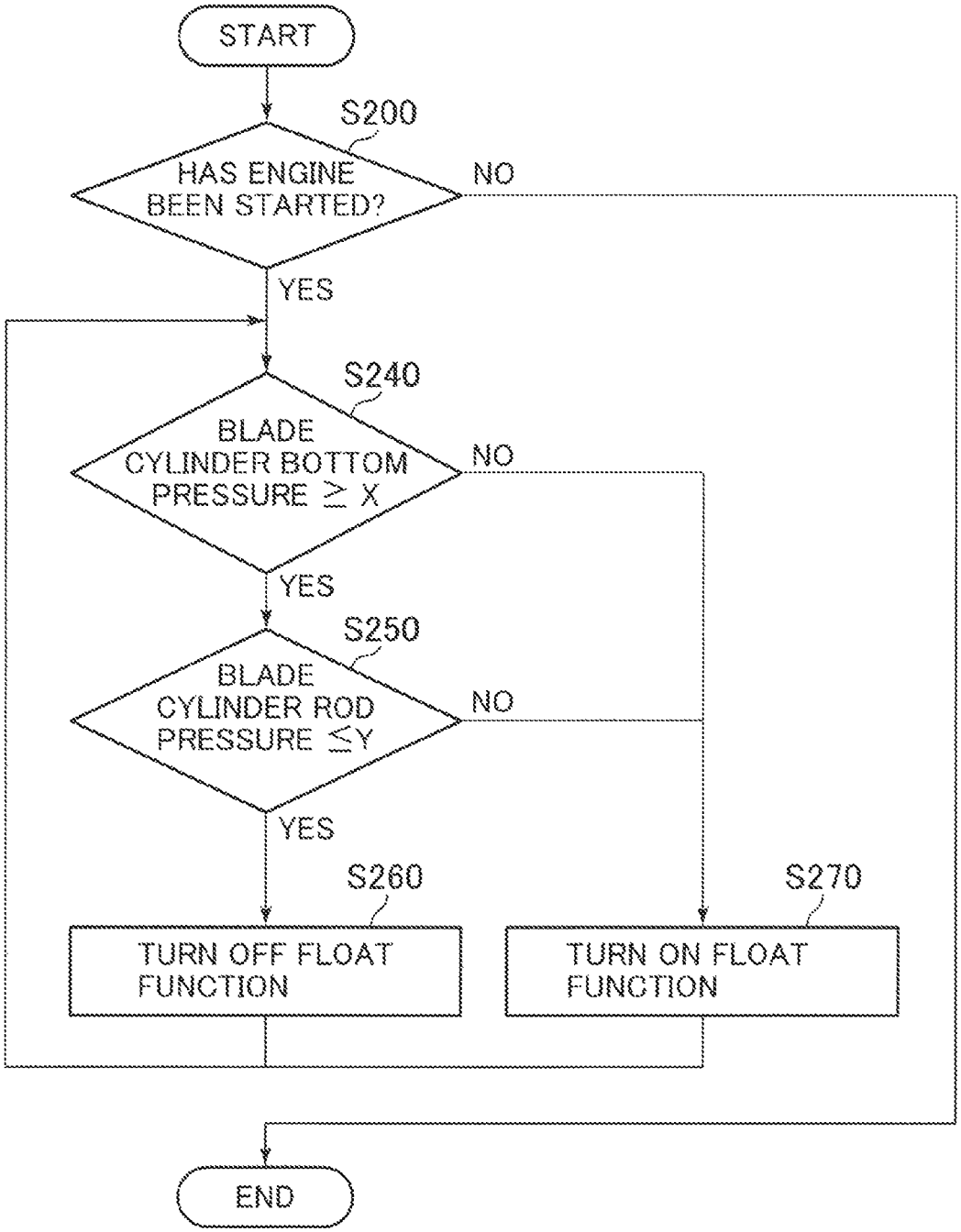
FIG. 7 is a flowchart illustrating a control function of a controller in the second embodiment.

FIG. 7 is a flowchart illustrating a control function of the controller 34A.

First, the controller 34A determines whether the engine 1 has been started (Step S200). The controller 34A makes this determination by determining whether a start signal has been input from a starter switch (not depicted). Upon determining that the engine 1 has not been started, the controller 34A ends a process.

Upon determining that the engine 1 has been started, the controller 34A then determines whether the pressure of the bottom-side hydraulic chamber 12*a* of the blade cylinder 12 is equal to or higher than the first determination pressure X using the detection signal from the first pressure sensor 32 (Step S240), and further determines whether the pressure of the rod-side hydraulic chamber 12*b* of the blade cylinder 12 is equal to or lower than the second determination pressure Y using the detection signal from the second pressure sensor 33 (Step S250). These determinations are the same as those in Steps S140 and S150 of FIG. 3 according to the first embodiment. In other words, when it has been determined in Step S240 that the pressure of the bottom-side hydraulic chamber 12*a* of the blade cylinder 12 is equal to or higher than the first determination pressure X and having determined in Step S150 that the pressure of the rod-side hydraulic chamber 12*b* of the blade cylinder 12 is equal to or lower than the second determination pressure Y, the controller 34A determines that the blade 304 is in the state of jacking up the machine body and performs the process for turning off the float function (Step S260). When it has been determined in Step S240 that the pressure of the bottom-side hydraulic chamber 12*a* of the blade cylinder 12 is lower than the first determination pressure X or having determined in Step S250 that the pressure of the rod-side hydraulic chamber 12*b* of the blade cylinder 12 is higher than the second determination pressure Y, the controller 34A determines that the blade 304 is in the state of not jacking up the machine body and performs the process for turning on the float function (Step S270).

In the process for turning off the float function in Step S260, the controller 34A outputs the control signal to the solenoid pressure reducing valve 31, and reduces the control pilot pressure o to the limit pressure Pij to prevent the blade directional control valve 3A from being changed over to the float position IV when the control pilot pressure o is higher than the limit pressure Pij (Step S260).

In the process for turning on the float function in Step S270, the controller 34A does not output the control signal to the solenoid pressure reducing valve 31 to cause the blade directional control valve 3A to be changed over to the float position IV (Step S270).

With the configuration described above, the blade operation lever device 22 configures the float instruction device.

The blade directional control valve 3A configures a float valve having the normal position III that enables the blade cylinder 12 to be driven, and the float position IV in which the bottom-side hydraulic chamber 12*a* and the rod-side hydraulic chamber 12*b* of the blade cylinder 12 are communicated with the tank T and in which the blade 304 is turned into the float state.

Furthermore, the first and second pressure sensors 32 and 33, the solenoid pressure reducing valve 31, and the controller 34A provide a float control device configured to change over the blade directional control valve 3A (float valve) to the float position IV when the blade 304 is not in the state of jacking up the machine body and the blade operation lever device 22 (float instruction device) has been operated, to change over the blade directional control valve 3A (float valve) from the float position IV to the normal position III when the blade directional control valve 3A (float valve) is in a state of being at the float position IV and the blade operation lever device 22 has been operated, and to keep the blade directional control valve 3A (float valve) at the normal position III irrespectively of an instruction by the blade operation lever device 22 (float instruction device) when the blade directional control valve 3A (float valve) is at the normal position III, the blade 304 is in the state of jacking up the machine body, and the blade operation lever device 22 (float instruction device) has been operated.

Operations

Operations performed by the hydraulic drive system of the present embodiment will be described.

Basic Operations

Basic operations are the same as those in the first embodiment.

Float Operation

When the float operation is performed, the operator operates the blade operation lever device 22 up to the detent position (maximum stroke position) in the blade lowering direction to change over the blade directional control valve 3A to the float position IV. The bottom-side hydraulic chamber 12*a* and the rod-side hydraulic chamber 12*b* of the blade cylinder 12 are then communicated with the tank T and the blade 304 is turned into the float state in which the blade 304 is unfixed. At this time, the blade 304 falls by the dead weight thereof to come in contact with the ground. When the hydraulic excavator is moved forward or backward in this state, the blade 304, which is in the float state, can follow up an undulating shape of the ground even if the ground has the undulations. It is, therefore, possible to perform the leveling work with the blade 304 always in contact with the ground.

Jack-Up Operation

When the blade 304 performs the jack-up operation, the operator operates the swing operation lever device 21*b* to invert the upper swing structure 300 by 180 degrees, and then causes the front work implement 302 to take the posture such that the bucket 308 contacts the ground as illustrated in FIG. 4. In this state, the operator operates the boom operation lever device 20*a* in the boom lowering direction to drive the boom cylinder 18 in the contraction direction, thereby driving the boom 306 in the lowering direction and floating the rear portion of the lower travel structure 301 from the ground. Next, the operator operates the blade operation lever device 22 in the blade lowering direction to change over the directional control valve 3A from the neutral position I of FIG. 5 to the lower position III thereof, and the hydraulic fluid delivered from the third hydraulic pump P3 is supplied to the bottom-side hydraulic chamber 12*a* of the blade cylinder 12 to drive the blade cylinder 12 in the extension direction, thereby driving the blade 304 in the lowering direction and floating the front portion of the lower travel structure 301 from the ground to cause the machine body to take the posture as illustrated in FIG. 4. Furthermore, when floating of the front portion of the lower travel structure 301 from the ground starts, the pressure of the bottom-side hydraulic chamber 12*a* of the blade cylinder 12 becomes higher than the first determination pressure X described above and the pressure of the rod-side hydraulic chamber 12*b* of the blade cylinder 12 becomes lower than the second determination pressure Y. These pressures are detected by the pressure sensors 32 and 33, the detection signals of the pressure sensors 32 and 33 are input to the controller 34A, and the controller 34 determines that the blade 304 is jacking up the machine body (body) and performs the process for turning off the float function (Step S200→Step S240→Step S250→Step S260). In other words, the controller 34A outputs the control signal to the solenoid pressure reducing valve 31, and reduces the control pilot pressure o to prevent the control pilot pressure o from becoming higher than the limit pressure Pij, and introduces an output pressure from the solenoid pressure reducing valve 31 to the blade directional control valve 3A to prevent the blade directional control valve 3A from being changed over to the float position IV. By doing so, even when the operator has operated the blade operation lever device 22 up to the detent position in which the control pilot pressure o becomes equal to the second set pressure Pi2, the control pilot pressure o generated by the blade operation lever device 22 is reduced to the limit pressure Pij described above by the solenoid pressure reducing valve 31 to prevent the blade directional control valve 3A from being changed over to the float position IV; thus, the operator can easily operate the jack-up.

Case of Operating Blade Operation Lever Device 22 in Blade Lowering Direction with Intention of Performing Blade Lowering Operation 1. Case in which Jack-Up is not being Performed When the blade 304 is not performing the jack-up operation, the pressure of the bottom-side hydraulic chamber 12*a* of the blade cylinder 12 is lower than the first determination pressure X. Owing to this, the controller 34A determines that the blade 304 is in the state of not jacking up the machine body (body), and performs the process for turning on the float function (Step S200→S240→S270). At this time, the controller 34A does not output the control signal to the solenoid pressure reducing valve 31; thus, the control pilot pressure o is introduced to the blade directional control valve 3A without reducing the control pilot pressure o when the operator has operated the blade operation lever device 22 in the blade lowering direction.

In this state, when the operator has operated the blade operation lever device 22 up to a position in which the control pilot pressure o becomes equal to the first set pressure Pi1 of FIG. 6 in the blade lowering direction for performing the ordinary blade lowering operation without performing the float operation, then the blade directional control valve 4 strokes out from the neutral position I of FIG. 5 to the lower normal position III thereof, the hydraulic fluid delivered from the third hydraulic pump P3 flows into the bottom-side hydraulic chamber 12*a* of the blade cylinder 12, and the blade cylinder 12 is driven in the extension direction to drive the blade 304 in the lowering direction.

Furthermore, when the operator has operated the blade operation lever device 22 up to the detent position with an intention of performing the float operation, then the control pilot pressure o becomes equal to the second set pressure Pi2 of the FIG. 6, the directional control valve 3A makes a full stroke to change over the directional control valve 3A from the neutral position I of FIG. 5 to the float position IV, the bottom-side hydraulic chamber 12*a* and the rod-side hydraulic chamber 12*b* of the blade cylinder 12 are communicated with the tank T, and the blade 304 is turned into the float state.

2. Case in which Jack-Up is being Performed

When the blade 304 is performing the jack-up operation, the pressure of the bottom-side hydraulic chamber 12*a* of the blade cylinder 12 is equal to or higher than the first determination pressure X. Owing to this, the controller 34A determines that the blade 304 is jacking up the machine body (body), and performs the process for turning off the float function (Step S200→Step S240→Step S250→Step S260). At this time, the controller 34A outputs the control signal to the solenoid pressure reducing valve 31.

In this state, when the operator has operated the blade operation lever device 22 up to the position in which the control pilot pressure o becomes equal to the first set pressure Pi1 of FIG. 6 in the blade lowering direction for performing the ordinary blade lowering operation without performing the float operation, then the blade directional control valve 3A strokes out from the neutral position I of FIG. 5 to the lower normal position III thereof, the hydraulic fluid delivered from the third hydraulic pump P3 flows into the bottom-side hydraulic chamber 12*a* of the blade cylinder 12, and the blade cylinder 12 is driven in the extension direction to drive the blade 304 in the lowering direction.

Furthermore, in the case in which the operator has operated the blade operation lever device 22 up to the detent position, then the control pilot pressure o is reduced to the first set pressure Pi1 of FIG. 6 by the solenoid pressure reducing valve 31, and the directional control valve 4 does not make a full stroke but strokes out from the neutral position I of FIG. 5 only to the normal position III. Owing to this, the bottom-side hydraulic chamber 12*a* and the rod-side hydraulic chamber 12*b* of the blade cylinder 12 are not communicated with the tank T and the blade 304 is not turned into the float state. It is thereby possible to prevent the blade 304 from being turned into the float state and prevent the falling of the body even when the operator has falsely operated the blade operation lever device 22 during the jack-up.

Effects

As described so far, according to the present embodiment, when the blade 304 is not in the state of jacking up the machine body, the blade operation lever device 22 (float instruction device) is operated to change over the blade directional control valve 3A (float valve) to the float position IV, thereby communicating the bottom-side hydraulic chamber 12*a* and the rod-side hydraulic chamber 12*b* of the blade cylinder 12 with the tank T at the float position VI; thus, it is possible to perform favorable leveling work with the blade 304 turned into the float state.

Furthermore, in the case in which the blade directional control valve 3A (float valve) is at the normal position III, the blade 304 is in the state of jacking up the machine body, and the blade operation lever device 22 (float instruction device) has been operated, the blade directional control valve 3A is kept at the normal position III irrespectively of the instruction by the blade operation lever device 22, thereby not communicating the bottom-side hydraulic chamber 12*a* and the rod-side hydraulic chamber 12*b* of the blade cylinder 12 with the tank T even when the blade operation lever device 22 has been operated; thus, it is possible to prevent the falling of the body even in the case of operator's false operation during the jack-up operation by the blade 304.

Moreover, according to the present embodiment, the solenoid pressure reducing valve 31 is provided not in an actuator line for a main hydraulic circuit between the blade directional control valve 3A and the blade cylinder 12 but in a pilot line for a pilot circuit introducing the control pilot pressure of the blade operation lever device 22 to the blade directional control valve 3A; thus, the added valve device (solenoid pressure reducing valve 31) may be an inexpensive and small-sized valve device and control reliability can be improved.

Others

In the embodiments described so far, the present invention has been applied to the three-pump type hydraulic drive system that includes the three hydraulic pumps P1, P2, and P3. However, the present invention can be realized irrespectively of the number of hydraulic pumps and the hydraulic drive system may include at least one hydraulic pump. Furthermore, while the first and second hydraulic pumps P1 and P2 out of the three hydraulic pumps P1, P2, and P3 are configured by the split-flow hydraulic pump 42, the first and second hydraulic pumps P1 and P2 may be different hydraulic pumps having a common regulator.

Moreover, in the embodiments, the present invention has been applied to the hydraulic drive system of the open center system that is configured such that the directional control valves 3 or 3A to 11 are the open center type and the hydraulic fluids delivered from the hydraulic pumps are returned to the tank when the directional control valves 3 or 3A to 11 are at the neutral positions. Alternatively, the present invention may be applied to a hydraulic drive system of a closed type that is configured such that the directional control valves are closed center valves and that includes a load sensing control function to return the hydraulic fluids delivered from the hydraulic pumps to the tank via an unloading valve when the directional control valves 3 or 3A to 11 are at the neutral positions.

DESCRIPTION OF REFERENCE CHARACTERS

1: Prime mover (diesel engine)
2: Control valve
3-11: Directional control valve
3: Blade directional control valve
3A: Blade directional control valve (float valve)
12-19: Actuator
12: Blade cylinder
12*a*: Bottom-side hydraulic chamber
12*b*: Rod-side hydraulic chamber
20, 21, 22, 24: Operation lever device
22: Blade operation lever device (float instruction device in second embodiment)
31: Solenoid pressure reducing valve (float control device in second embodiment)
32, 33: First and second pressure sensors (float control device: jack-up sensor)
34: Controller (float control device)
34A: Controller (float control device)
35, 36: Third or fourth pressure sensor (float control device: blade operation sensor in first embodiment)
37: Float switch (float instruction device)
38: Float valve
41: Regulator
300: Upper swing structure
301: Lower travel structure
302: Front work implement
304: Blade
P1, P2, P3: First, second, or third hydraulic pump
P4: Pilot pump

The invention claimed is:

1. A hydraulic drive system for a hydraulic excavator, comprising:

a machine body that has a lower travel structure and an upper swing structure swingably mounted on the lower travel structure;

a front work implement attached to the upper swing structure in such a manner as to be vertically rotatable; and a blade attached to a front portion of the lower travel structure, wherein the hydraulic drive system for the hydraulic excavator comprises:

a plurality of actuators driven by a hydraulic fluid delivered from at least one hydraulic pump;

a plurality of directional control valves that control flows of the hydraulic fluid supplied to the plurality of actuators from the hydraulic pump; and a plurality of operation lever devices that are connected to a pilot hydraulic fluid source and that generate control pilot pressures for operating the plurality of directional control valves with a hydraulic pressure of the pilot hydraulic fluid source assumed as a main pressure, wherein the plurality of actuators include a blade cylinder for driving the blade, and the plurality of directional control valves include a blade directional control valve that controls the flow of the hydraulic fluid supplied to the blade cylinder, and the plurality of operation lever devices include a blade operation lever device that generates the control pilot pressures for operating the blade directional control valve, characterized in that:

the hydraulic drive system for the hydraulic excavator further comprises:

a float instruction device;

a float valve having a normal position that enables the blade cylinder to be driven, and a float position in which a bottom-side hydraulic chamber and a rod-side hydraulic chamber of the blade cylinder are communicated with a tank and in which the blade is turned into a float state; and a float control device configured to change over the float valve to the float position when the blade is not in a state of jacking up the machine body and the float instruction device has been operated, to change over the float valve from the float position to the normal position when the float valve is in a state of being at the float position and the blade operation lever device has been operated, and to keep the float valve at the normal position irrespectively of an instruction by the float instruction device when the float valve is at the normal position, the blade is in the state of jacking up the machine body, and the float instruction device has been operated.

2. The hydraulic drive system for the hydraulic excavator according to claim 1, wherein the float valve is a valve device that is disposed in an actuator hydraulic line between the blade directional control valve and the blade cylinder and that has the position changeable over between the normal position and the float position, the float instruction device is a float switch operated by an operator, and the float control device includes:

a jack-up sensor that detects whether the blade is jacking up the machine body;

a blade operation sensor that detects whether the blade operation lever device has been operated; and a controller configured to change over the float valve to one of the normal position and the float position on the basis of detection results of the jack-up sensor and the blade operation sensor and an instruction signal of the float switch.

3. The hydraulic drive system for the hydraulic excavator according to claim 1, wherein the float instruction device is the blade operation lever device, the float valve is incorporated into the blade directional control valve, the blade directional control valve is configured such that the blade directional control valve is changed over to the normal position when the blade operation lever device has been operated in a lowering direction of the blade and the control pilot pressure rises up to a first set pressure, and such that the directional control valve is changed over to the float position and the blade directional control valve functions as the float valve when the blade operation lever device has been operated in the lowering direction of the blade and the control pilot pressure rises up to a second set pressure higher than the first set pressure, the float control device includes:

a jack-up sensor that detects whether the blade is jacking up the machine body;

a solenoid pressure reducing valve that is disposed between the blade operation lever device and the blade directional control valve; and a controller configured to output a control signal to the solenoid pressure reducing valve when the jack-up sensor has detected that the blade is jacking up the machine body, and to reduce a pressure of the blade operation lever device in such a manner that the blade directional control valve is kept at the normal position.

4. The hydraulic drive system for the hydraulic excavator according to claim 2 or 3, wherein the jack-up sensor includes a first pressure sensor that detects a pressure of a bottom-side hydraulic chamber of the blade cylinder and a second pressure sensor that detects a pressure of a rod-side hydraulic chamber of the blade cylinder, and the controller determines that the blade is jacking up the machine body when the pressure of the bottom-side hydraulic chamber of the blade cylinder is equal to or higher than a first determination pressure and the pressure of the rod-side hydraulic chamber of the blade cylinder is equal to or lower than a second determination pressure lower than the first determination pressure.

* * * * *